US005542801A

United States Patent [19]

Vahabi-Nejad et al.

[11] Patent Number: 5,542,801

[45] Date of Patent: Aug. 6, 1996

[54] MANUAL BINDING APPARATUS FOR FLEXIBLE BOOKBINDING STRIPS

[75] Inventors: Mariam Vahabi-Nejad, Chicago; Daniel A. Rice, Buffalo Grove, both of Ill.

[73] Assignee: VeloBind, Inc., Northbrook, Ill.

[21] Appl. No.: 266,952

[22] Filed: Jun. 27, 1994

[51] Int. Cl.[6] ..... B42D 9/00

[52] U.S. Cl. ..... 412/43

[58] Field of Search ..... 402/80, 7, 9, 13, 402/33, 43; 281/21.1; 83/372

[56] References Cited

U.S. PATENT DOCUMENTS

| | | | |
|---|---|---|---|
| 4,354,783 | 10/1982 | Szanto | 412/13 |
| 4,645,399 | 2/1987 | Scharer | 412/16 |
| 4,674,906 | 6/1987 | Abildgaard | 402/80 |
| 4,685,700 | 8/1987 | Abildgaard | 281/21 |
| 4,846,616 | 7/1989 | Abildgaard et al. | 412/7 |
| 4,906,157 | 3/1990 | Todaro et al. | 412/43 |
| 5,015,138 | 5/1991 | Crudo et al. | 412/43 |
| 5,017,071 | 5/1991 | Todaro et al. | 412/43 |

*Primary Examiner*—Willmon Fridie, Jr.

*Attorney, Agent, or Firm*—Flehr, Hohbach, Test, Albritton & Herbert

[57] ABSTRACT

A binding apparatus for bookbinding strips with flexible studs. The binding apparatus includes a frame having a recess shaped to receive the female strip and a platen for supporting the sheets to be bound. A compression member on the frame compresses the male and female strips toward one another with said sheets positioned between the strips. At least one carriage assembly is mounted to the frame and the compression member for movement parallel to the strips. The carriage assembly engages the compression member for applying a compressive force thereto and has at least one stud-bending member shaped and positioned to engage the excess length of the studs extending beyond the female strip and bend the excess length into grooves in the female strip as the carriage assembly is moved relative to the compression member and the frame.

25 Claims, 4 Drawing Sheets

MANUAL BINDING APPARATUS FOR FLEXIBLE BOOKBINDING STRIPS

BACKGROUND OF THE INVENTION

1. Field of the Invention

This invention relates to a new and improved binding apparatus for bookbinding strips with flexible studs. More particularly, the invention relates to a manually operated binding machine used to compress two bookbinding strips together about a stack of paper and bend the flexible studs projecting from one strip into engagement with the other strip.

2. Prior Art

Pairs of bookbinding strips having cooperating flexible studs and grooves are often used to bind several sheets of paper together. As is illustrated and described in U.S. Pat. Nos. 4,674,906 and 4,685,700, the flexible studs formed on one of the strips extend through holes formed in the sheets and the other strip. The excess lengths of the studs extending beyond the second strip are bent and snapped into grooves formed in the second strip. The engagement between the studs and the grooves binds the strips to the sheets of paper.

Manually and automatically operated machines are available for mechanically bending the flexible studs of the male strip into the grooves formed in the female strip. The manual binding apparatus disclosed in U.S. Pat. No. 4,906,157 includes a pressure bar for compressing the studs toward one another and an inverted T-shaped lever. The pressure bar is lowered and pressed against the male strip by a rack and pinion mechanism. As the T-shaped lever is pivoted, a pair of blocks are moved parallel to the strips causing pins mounted to the blocks to engage the flexible studs and bend the excess lengths of the studs into the grooves.

The apparatus disclosed in U.S. Pat. No. 5,015,138 includes a pressure bar which is lowered and pressed against the strip by a rotatable cam shaft. The rotatable cam shaft has a drum-type cam with two separate grooves controlling the reciprocal movement of two carriages in a direction parallel to the binding strips. Rollers mounted to the carriages bend the flexible studs into the grooves in the female strip. The disclosed apparatus is preferably motor driven, although it may also be manually operated with a lever arm.

This invention provides a simplified, manually operated desk top apparatus for bending the flexible studs of bookbinding strips. The pressure bar is manually lowered onto the upper surface of the male strip. A compressive force is applied to the pressure bar to press the bar against the male strip and the flexible studs are bent into the grooves in the female strip by manually moving a pair of blocks parallel to the strip.

SUMMARY OF THE INVENTION

The binding apparatus of the present invention is used to bind a pair of binding strips to several sheets of paper or other material. Although not part of the present invention, the apparatus preferably includes a punch for forming the necessary holes in the sheets. The apparatus has a recess shaped to receive a female strip and a platen for supporting the sheets to be bound with the holes in the sheets aligned with the holes in the female strip. A male strip is positioned on the exposed surface of the uppermost sheet with the flexible studs passing through the holes in the sheets and the female strip.

The binding apparatus has a compression member which is manually lowered onto the male strip and at least one carriage assembly movable in a direction substantially parallel to the strips. Preferably, the binding apparatus has two carriage assemblies movable in opposite directions. Each carriage assembly has at least one stud-bending member shaped and positioned to engage the excess lengths of the studs extending beyond the female strip. When moved relative to the frame, the carriage assemblies apply a compressive force to the compression member to press the strips toward one another and the stud-bending member bends the studs into the grooves in the female strip. The carriage assemblies may then be returned to their initial positions and the compression member manually lifted from the male strip to release the bound sheets from the binding apparatus.

Other objects of the present invention will become apparent upon reading the following specification and referring to the accompanying drawings.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
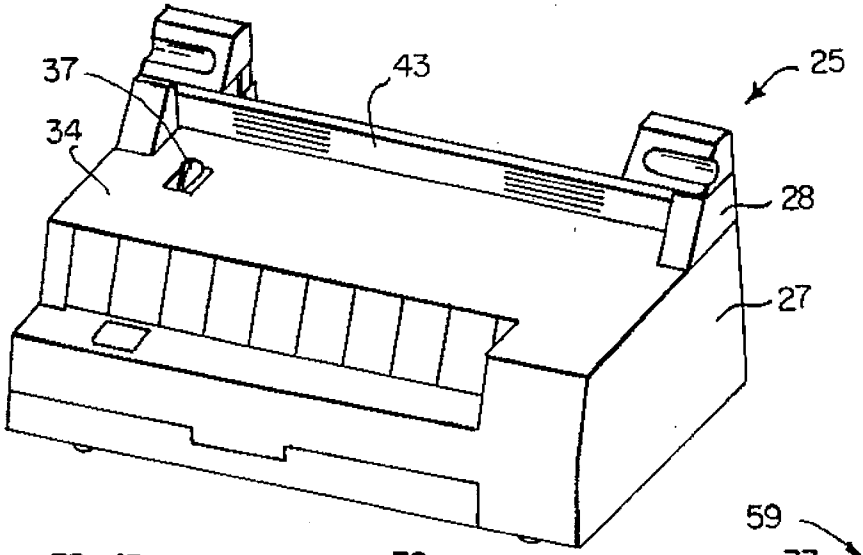
FIG. 1 is a perspective view of a manual binding apparatus in accordance with the present invention, shown with the pressure bar lowered onto the platen.
Figure 2:
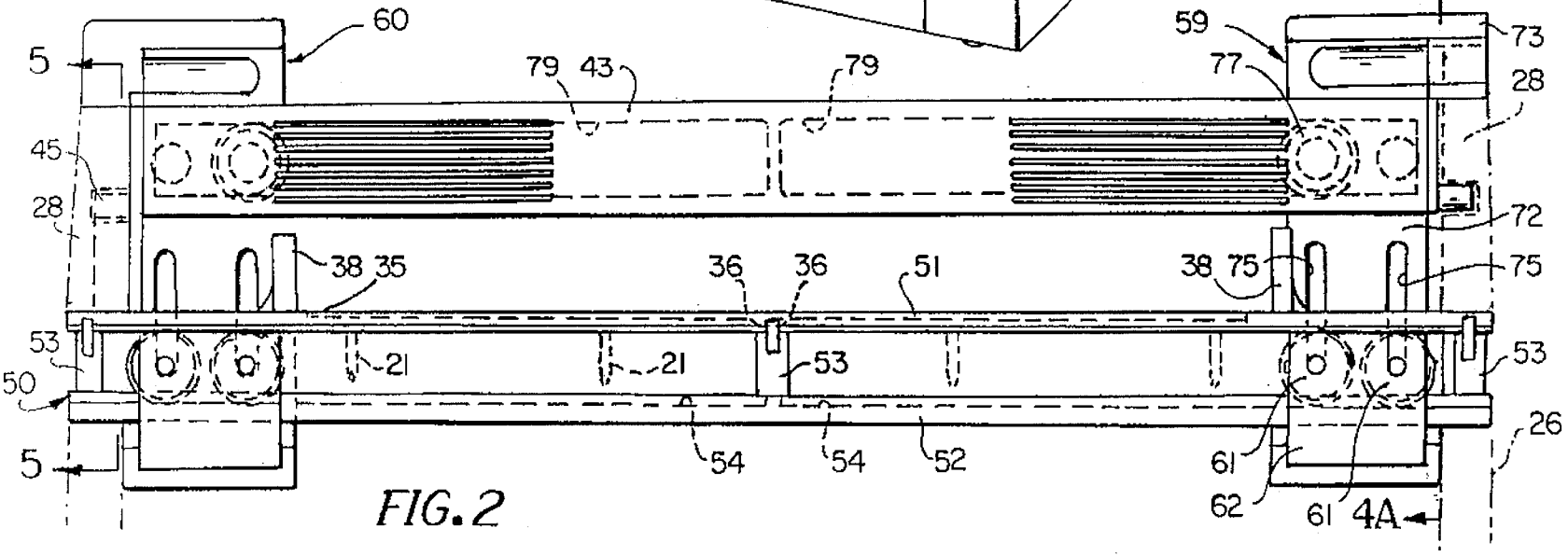
FIG. 2 is a front plan view, partially broken away, of the manual binding apparatus of FIG. 1, shown with the housing removed.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The plastic bookbinding strips used with the present invention are disclosed, for example, in U.S. Pat. Nos. 4,674,906 and 4,685,700, the disclosures of which are hereby incorporated herein by reference. The bookbinding strips generally comprise a male strip 11 having flexible studs 12 and a female strip 13 having holes 14 spaced at the same intervals as the studs 12 on the male strip 11 and grooves 15. The external edges of the grooves 15 are formed with lips 16 dimensioned so that the spacing between the lips 16 is less than the thickness of the studs 12. Preferably, the grooves extend inwardly from the holes 14 toward the center of the strip. The male strip 11 has four studs 12 with the two studs on each side of the strip 11 being bent toward the center of the strip. However, it should be understood that the number of studs 12 and the orientation of grooves 15 is optional.

Figure 7:
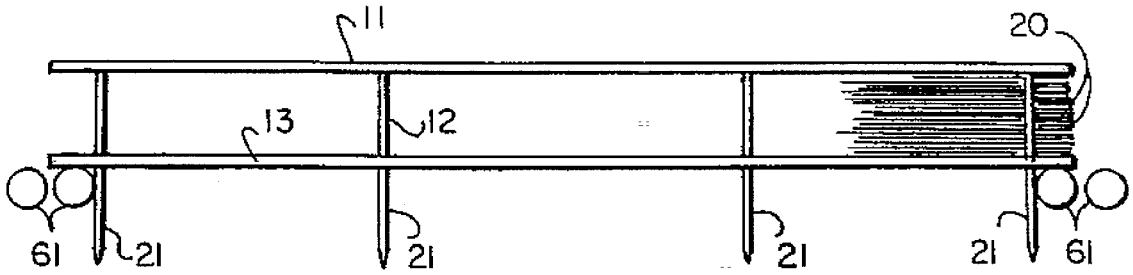
FIG. 7 is a schematic view showing strips at the commencement of the binding operation.
Figure 8:
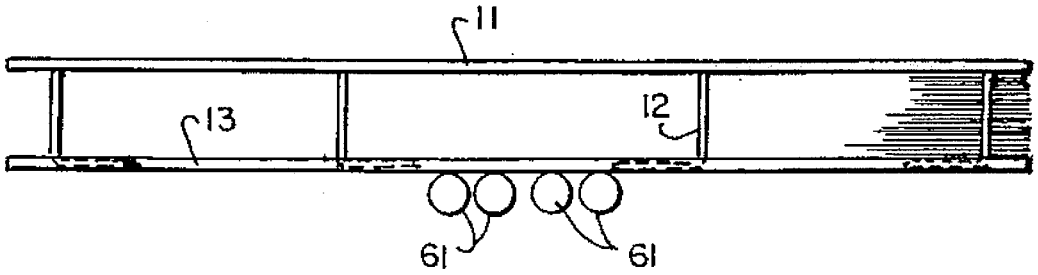
FIG. 8 is a view similar to FIG. 7 showing completion of the binding operation.
Figure 9:
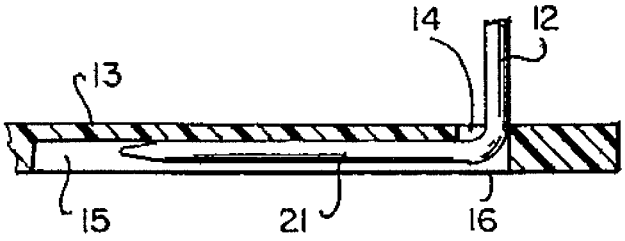
FIG. 9 is an enlarged fragmentary sectional view showing a stud bent into the groove of a strip.

The binding strips 11 and 13 are used to bind sheets 20 of paper, book cover material, or the like as shown in FIGS. 7–9. Sheets 20 are formed with holes (not shown) spaced at the same intervals as the studs 12 on the male strip 11 and the holes 14 formed in the female strip 13. The strips 11 and 13 are positioned on opposite sides of the sheets 20 with studs 12 extending through the holes in the sheets and the holes 14 in the female strip 13. The excess lengths 21 of the studs 12 projecting beyond the female strip are bent at approximately right angles by the operation of the binding machine hereinafter described and snapped into the grooves 15 in the female strip.

A binding machine 25 for bending the studs 12 into the grooves 15 and binding the strips 11 and 13 to sheets 20 is shown in FIGS. 1–6. Machine 25 preferably includes a punch assembly (not shown) for forming the necessary holes in the sheets 20. U.S. Pat. No. 4,354,783 discloses such a punch assembly, but other punches installed in, or separate from, the binding machine may be used.

The binding machine 25 has a frame 26 enclosed within a housing 27 and having spaced end caps or side plates 28 and a horizontal platen 34 for supporting sheets 20 during the binding operation. A transversely extending recess 35 shaped to receive the female strip 13 is positioned at the rearward edge of the binding machine 25. The bottom surface of the recess 35 has two transversely extending openings 36 for receiving the excess lengths 21 of the studs 12 and exposing the grooves 15 in the female strip 13. Preferably, the depth of the recess 35 is approximately equivalent to the thickness of the female strip 13 so that the upper surface of the strip 13 is substantially aligned with the surface of the platen 34. A vertical guide 38 and an edge guide 37 positioned adjacent the recess 35 square the rearmost edges of sheets 20 and substantially align the sheets with the rearmost edge of the strip 13. The edge guide 37 is movable to accommodate sheets having different widths.

A transverse pressure bar or compression member 43 positioned between the side plates 28 is movable relative to the frame 26, with the bar 43 being elevated above the platen 34 when the binding machine 25 is not in use and lowered onto the upper surface of the male strips 11 during operation of the machine. In the illustrated modification, the side frames 28 have inverted, L-shaped slots 44 (FIG. 5) and the pressure bar 43 has outward extending ears 45 (FIGS. 2 and 5) on the opposite ends of the bar. The ears 45 slidably engage the slots 44 to mount the pressure bar 43 to the frame 26 for vertical movement of the pressure bar relative to the platen 34. The pressure bar is retained in an elevated position spaced from the platen 34 by positioning the ears 45 in the horizontal stretch of the L-shaped slots 44. The pressure bar 43 may be lowered from the elevated position by manually pulling the bar forward until the ears 45 reach the vertical stretch of the slots 44 and then lowering the pressure bar onto the strips. As is hereinafter described, the pressure bar 43 is used to press the strips 11 and 13 toward one another during operation of the binding machine 25.

Figure 3:
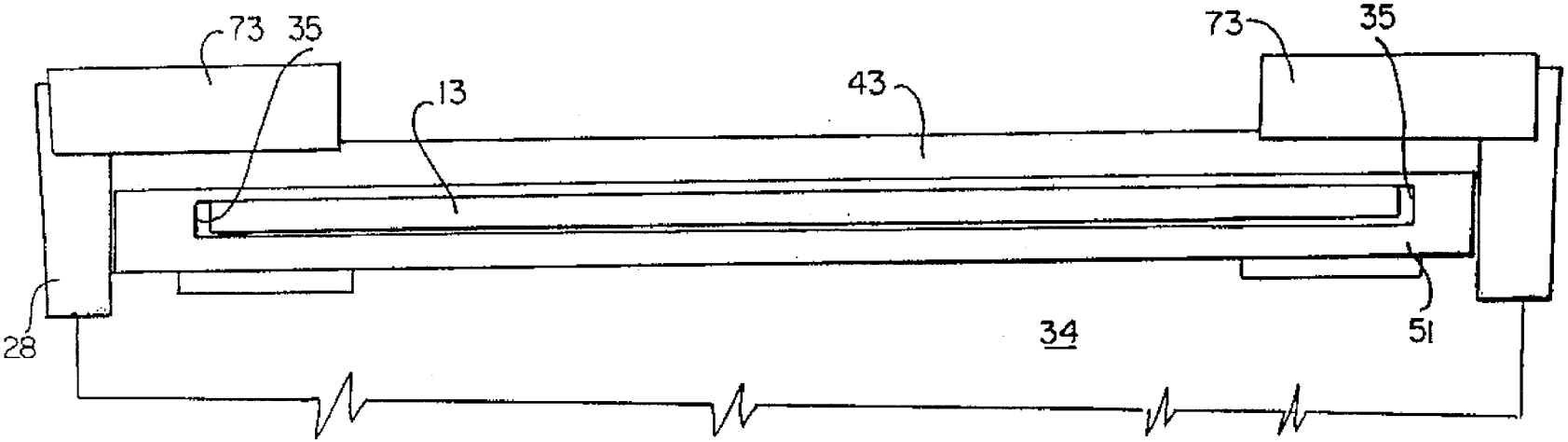
FIG. 3 is a top plan view, partially broken away, of the manual binding apparatus of FIG. 1.
Figure 6:
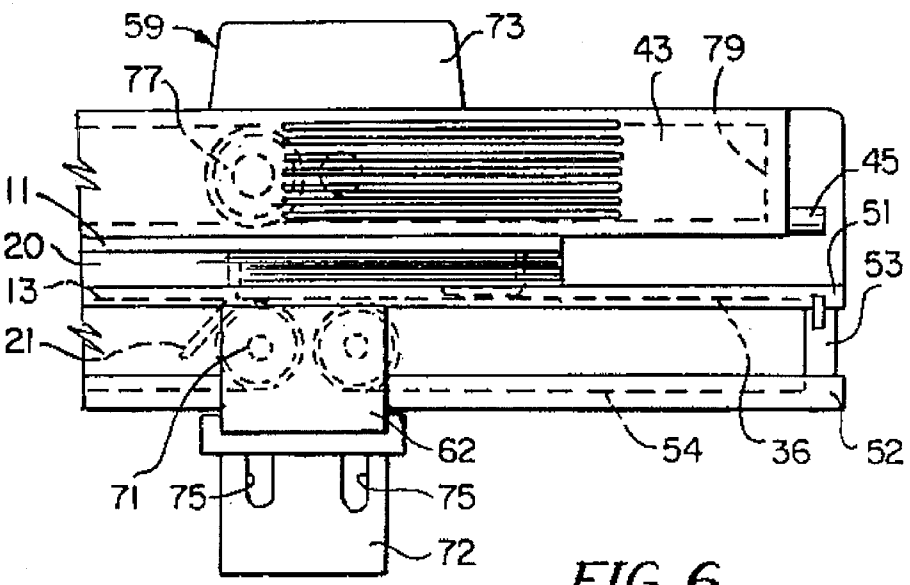
FIG. 6 is a front plan view, partially broken away, of the manual binding machine, shown during operation.
Figure 5:
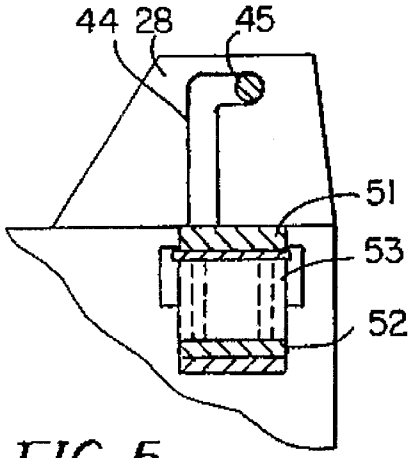
FIG. 5 is a cross sectional view taken substantially along line 5—5 in FIG. 1.

A transversely extending track assembly, generally designated 50, is supported by the frame 26. The track assembly 50 includes vertically spaced upper and lower guide plates 51 and 52 separated by spacer blocks 53. As shown in FIG. 3, in the illustrated modification the upper guide plate 51 is positioned at the rearward edge of the platen 34. The recess 35 is formed in the guide plate 51 and the openings 36 formed in the bottom of the recess 35 extend through the lower surface of the guide plate 51. When the strips 11 and 13 and the sheets 20 are positioned on the platen, the studs 12 extend through the openings 26 in the upper guide plate 51. The lower guide plate 52 has two transversely extending grooves 54 parallel to and substantially aligned with openings 36 in the upper guide plate.

Two carriage assemblies 59 and 60 are mounted to the pressure bar 43 and track assembly 50 for movement relative to the frame 26 in opposite directions substantially parallel to the recess 35. In the modification illustrated in FIGS. 1–6, the carriage assemblies 59 and 60 are movable in opposite directions from an outward position to an inward position at the center of the recess 35 for bending the studs 12 into the grooves 15 in the female strip 13. However, it should be understood that in other modifications of the invention the carriage assemblies may be moved in the same direction. Moreover, if desired, the machine may include only one carriage assembly instead of two carriage assemblies as in the illustrated modification. Since the carriage assemblies are substantially identical, only carriage assembly 59 will be described in detail.

Figure 4C:
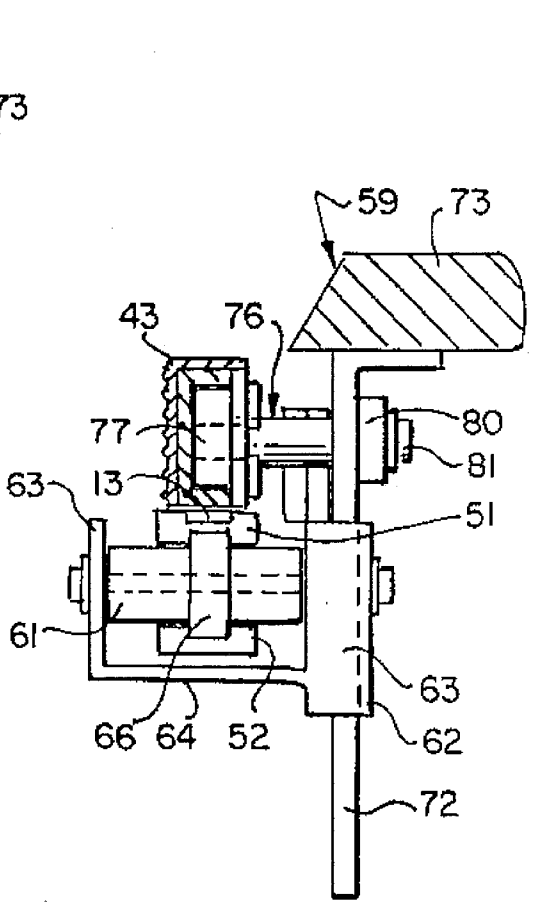
FIG. 4C is a view similar to FIG. 4A, shown with the pressure bar in a third position.
Figure 4B:
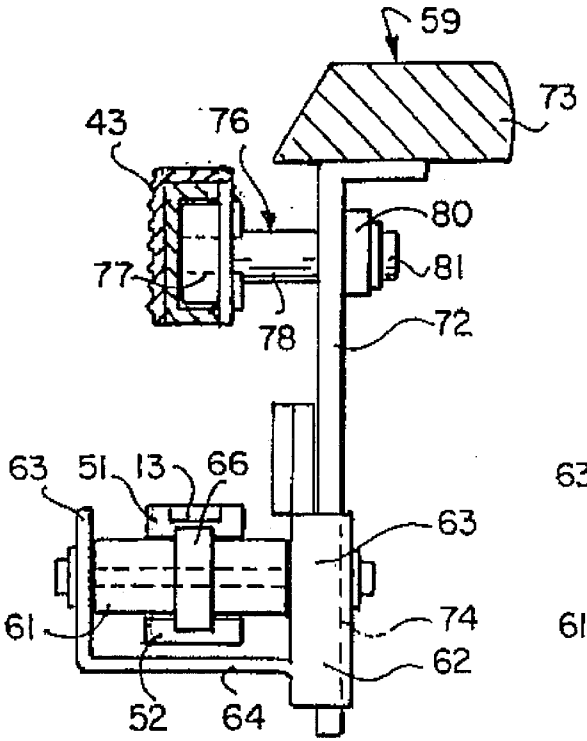
FIG. 4B is a view similar to FIG. 4A, shown with the pressure bar in a second position.
Figure 4A:
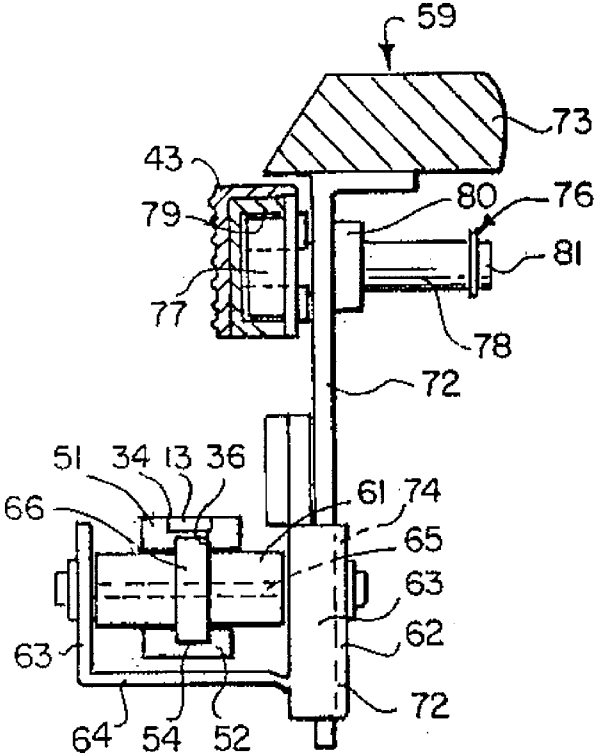
FIG. 4A is a cross sectional view taken substantially along line 4A—4A in FIG. 1.

Carriage assembly 59 has two stud contractors or rollers 61 rotatably mounted to a U-shaped roller support 62. Instead of rollers 61, other stud contractors may be used as for example rectangular blocks slidable in the track assembly 50. As shown in FIGS. 4A–4C, the roller support 62 has opposed legs 63 extending upward from a cross member 64 on opposite sides of the lower guide plate 52. The rollers 61 are mounted to a pin 65 extending between the opposed legs 63 of the roller support and positioned to engage the lower surface of the upper guide plate 51 and the upper surface of the lower guide plate 52. The pins 65 are sufficiently spaced from the cross member 64 to provide clearance between the cross member and the guide plate 52 for unrestricted movement of the U-shaped roller support 62 relative to the guide plate.

In the illustrated modification, the roller 61 is provided by a cylindrical shaft with an annular rib 66 which fits within the opening 36 in the guide plate 51 and the groove 54 in the guide plate 52. The rib 66 guides the U-shaped support 62 when it is moved along the track assembly 50. As the U-shaped support 62 is moved relative to the frame 26, the ribs 66 engage the studs 12 passing through the opening 36 and bend the excess lengths 21 into the grooves 15 in the female strip. Preferably, the ribs 66 are shaped to engage the lower surface of the female strip when the strip 13 is seated in the recess 35 so that the entire excess length 21 of each stud may be snapped into the grooves by the rollers 61. However, it is to be understood that the roller 61 may take other forms as desired.

The carriage assembly 59 has a vertical support plate 72 coupled to the U-shaped roller support 62 and the pressure bar 43. Preferably, the support plate 72 has a handle 73 which may be used by an operator to manually move the carriage assembly 59 between the inward and outward positions. The lower portion of the support plate 72 is positioned between a pair of spaced apart, inturned flanges 74 on the exterior of the rear leg 63 and is coupled to the U-shaped support by pins 65. The pins 65 slidably engage a pair of vertical slots 75 formed in the lower half of support plate 72, permitting vertical movement of the support plate 72 relative to the U-shaped support 62 as the pressure bar 43 is raised and lowered relative to the platen 34.

The upper end of the support plate 72 is secured to the pressure bar 43 by a roller assembly 76. As shown particularly in FIGS. 4A–4C, the roller assembly 76 includes a pressure member or roller 77 mounted to a shaft 78 and retained in a channel 79 in the pressure bar 43. The shaft 78 is supported by a retaining bracket 80 and is secured thereto by a nut 81 or other securement means mounted to the distal end of the shaft to prevent the shaft from being completely withdrawn from the retaining bracket. The shaft 78 slips through the retaining bracket when the ears 45 on the bar slide along the horizontal stretch of the L-shaped slots 44 in the frame 26, moving the pressure bar 43 in a transverse direction relative to the vertical support plate 72 as shown in FIGS. 4A and 4B. After the pressure bar 43 has been lowered onto the upper surface of the male strip (FIG. 4C), the operator moves the carriage assembly inward toward the center of the recess 35. The roller 77 applies a downward directed, compressive force to the pressure bar, pressing the bar 43 against the strips 11 and 13. Simultaneously, the rollers 61 mounted to the U-shaped support 62 engage the studs 12 directly beneath the roller 77 and bend the excess lengths 21 of the studs into the grooves. The roller 77 thereby ensures optimum compression of the sheets bound between the strips. However, it is to be understood that instead of the roller 77 shown in the illustrated modification, other types of pressure members may be used as for example a block which is slidable in the channel 79 of the compression bar.

PREFERRED OPERATION

Prior to operation of the binding machine 25, the carriage assemblies 59 and 60 are moved to their outward positions and the pressure bar 43 is located in the elevated position. A female strip 13 is positioned in the recess 35 with the grooves 15 facing downward. Holes are punched in the sheets to be bound using the punch associated with the binding machine 25 or other punch means. The sheets 20 are positioned on the platen 34 with the punched holes substantially aligned with the holes 14 in the female strip. A male strip 11 is then placed on the uppermost sheet with the studs 12 passing through the aligned holes in the sheets 20 and the female strip 13.

The pressure bar 43 is pulled forward and then lowered unto the upper surface of the male strip 11, with the ears 45 sliding along the L-shaped slots 43, the shafts 78 sliding through the retaining brackets 80 and the support plate 72 being lowered relative to the U-shaped support 62. The operator grasps the handles 73 and moves the carriage assemblies 59 and 60 inward toward the center of the recess 35. As the carriage assemblies are moved. The rollers 77 apply a downward directed force to the pressure bar 43, pressing the pressure bar 43 against the strips so that the strips sufficiently compress the bound sheets together. The rollers 61 engage the studs 12 and bend the excess lengths 21 of the studs into the grooves 15 in the female strip.

After the carriages 59 and 60 have reached the inward position, the operator moves the carriage assemblies outward to the opposite ends of the machine 25. The pressure bar 43 is manually lifted, moving the support plate 72 upward relative to the U-shaped support, and is pushed toward the rearward edge of the platen 34 causing the ears 45 to slide into the horizontal stretch of the L-shaped slots 44 and the shaft 78 to slide through support plate 72. The bound sheets 20 may then be lifted from the platen 34.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A binding machine for binding a male strip having flexible studs and a female strip having grooves formed therein to a stack of sheets with said studs passing through said sheets and said female member and the excess length of said studs extending beyond said female member being retained in said grooves, said machine comprising:

a frame having a recess shaped to receive said female strip, a substantially linear track extending in a direction substantially parallel to said recess, and a platen for supporting said sheets;

a compression member on said frame for compressing said male strip and said female strip toward one another with said sheets positioned between said strips; and at least one carriage assembly mounted to said frame and said compression member for movement along said linear track in a direction parallel to said recess, said carriage assembly engaging said compression member for applying a compressive force thereto and said carriage assembly having stud-bending means shaped and positioned to engage said excess length of said studs and bend said excess length into said grooves when said carriage assembly is moved relative to said compression member and said frame.

2. The machine of claim 1 which further comprises a second carriage assembly mounted to said frame and said compression member for movement along said linear track opposite said first-mentioned carriage assembly, said second carriage assembly engaging said compression member for applying a compressive force thereto and having second stud-bending means for bending said excess length of said studs into said grooves as said second carriage assembly is moved relative to said compression member and said frame.

3. The machine of claim 1 in which said stud-bending means comprises at least one stud contractor movable along said linear track, said linear track being positioned and said stud contractor being shaped such that when said carriage assembly is moved relative to said frame, said stud contractor bends said excess length of said studs into said grooves.

4. The machine of claim 3 in which said stud contractor comprises a roller.

5. The machine of claim 4 in which said roller comprises a cylindrical shaft having an annular rib protruding from said shaft, said rib being shaped and dimensioned to engage said excess length of said studs and bend said excess length into said grooves.

6. The machine of claim 3 in which said linear track is positioned at an elevation such that said stud contractor engages said female strip when said female strip is seated in said recess.

7. The machine of claim 3 in which said stud-bending means comprises two stud contractors movable relative to said linear track.

8. A binding machine for binding a male strip having flexible studs and a female strip having grooves formed therein to a stack of sheets with said studs passing through said sheets and said female member and the excess length of said studs extending beyond said female member being retained in said grooves, said machine comprising:

a frame having a recess shaped to receive said female strip, a platen for supporting said sheets and track means substantially parallel to said recess;

a compression member on said frame for compressing said male strip and said female strip toward one another with said sheets positioned between said strips;

at least one carriage assembly mounted to said frame and said compression member for movement parallel to said recess, said carriage assembly engaging said compression member for applying a compressive force thereto and said carriage assembly having at least one stud contractor movable in said track means, said stud contractor being shaped and said track means being positioned such that when said carriage assembly is moved relative to said compression member and said frame, said stud contractor bends said excess length of said studs into said grooves; and said carriage assembly having a U-shaped support having opposed legs and said track means including a guide plate spaced from said recess and extending between said opposed legs, said stud contractor being mounted to said opposed legs of said U-shaped support.

9. The machine as in claim 8 in which said guide plate has a transversely extending groove formed therein, said groove being substantially parallel to said recess and being shaped to receive at least a portion of said stud contractor.

10. A binding machine for binding a male strip having flexible studs and a female strip having grooves formed therein to a stack of sheets with said studs passing through said sheets and said female member and the excess length of said studs extending beyond said female member being retained in said grooves, said machine comprising:

a frame having a recess shaped to receive said female strip and a platen for supporting said sheets;

a compression member on said frame for compressing said male strip and said female strip toward one another with said sheets positioned between said strips;

at least one carriage assembly mounted to said frame and said compression member for movement parallel to said recess, said carriage assembly engaging said compression member for applying a compressive force thereto and said carriage assembly having stud-bending means shaped and positioned to engage said excess length of said studs and bend said excess length into said grooves when said carriage assembly is moved relative to said compression member and said frame; and said compression bar having a longitudinally extending channel formed therein and said carriage assembly including at least one pressure member mounted for movement in said channel as said carriage assembly is moved relative to said frame.

11. The machine of claim 10 in which said pressure member comprises a roller.

12. The machine of claim 1 in which said carriage assembly includes a support member coupled to said compression member, said support member being movable with said compression bar in a direction perpendicular to said recess between a raised position and a lowered position.

13. The machine of claim 12 in which said support member has at least one slot formed therein, said stud-bending means being coupled to said support member and movable in said slot when said support member is moved between said raised position and said lowered position.

14. The machine of claim 1 in which said frame member has a pair of slots and said compression member has a pair of ears engaging said slots, said ears being movable in said slots when said compression member is manually moved between a stored position spaced from said platen and a deployed position engaging said strips.

15. The machine of claim 1 in which said carriage assembly has a handle for moving said carriage assembly relative to said frame and applying a compressive force to said compression bar during movement of said carriage assembly.

16. A binding machine for binding a male strip having flexible studs and a female strip having grooves formed therein to a stack of sheets with said studs passing through said sheets and said female member and the excess length of said studs extending beyond said female member being retained in said grooves, said machine comprising:

a frame having a first guide member, a second guide member spaced from said first guide member and a platen for supporting said sheets, said first guide member having a recess shaped to receive said female strip, said recess having a support surface for supporting said female strip when said female strip is positioned in said recess and at least one opening formed in said support surface for exposing said excess length of said studs and said grooves in said female strip;

at least one carriage assembly mounted for movement relative to said frame in a direction substantially parallel to said strips, said carriage assembly having at least one stud contractor mounted between said guide members, said stud contractor being movable between said guide members to engage said excess length of said studs and bend said excess length into said grooves when said carriage assembly is moved relative to said frame; and a compression member coupled to said frame and said carriage assembly, said compression member being movable between a stored position spaced from said recess and a deployed position pressing said male strip and said female strip together with said sheets positioned between said strips.

17. The machine of claim 16 which further comprises a second carriage assembly mounted to said frame for movement opposite said first-mentioned carriage assembly, said second carriage assembly having at least one second stud contractor mounted between said guide members for bending said excess length of said studs into said grooves.

18. The machine of claim 16 in which said second guide member is positioned at an elevation relative to said first guide member so that said stud contractor engages said female strip when said female strip is seated in said recess.

19. The machine of claim 16 in which said second guide member has a groove formed therein, said groove being substantially parallel to and aligned with said opening, and in which said stud contractor has an rib positioned in said groove and said opening for bending said excess length of said studs.

20. The machine of claim 16 in which said carriage has two stud contractors movable in said track means.

21. The machine of claim 16 in which said stud contractor comprises a roller.

22. The machine of claim 16 in which said carriage assembly is coupled to said compression bar for applying a compressive force thereto as said carriage assembly is movable relative to said frame.

23. The machine of claim 16 in which said compression bar has a longitudinally extending channel formed therein and in which said carriage assembly includes at least one pressure member mounted for movement in said channel when said carriage assembly is moved relative to said frame.

24. The machine of claim 23 in which said pressure member comprises a roller.

25. A binding machine for binding a male strip having flexible studs and a female strip having grooves formed therein to a stack of sheets with said studs passing through said sheets and said female member and the excess length of said studs extending beyond said female member being retained in said grooves, said machine comprising:

a frame having a recess shaped to receive said female strip, a platen for supporting said sheets, and track means substantially parallel to said recess;

a compression member on said frame for compressing said male strip and said female strip toward one another with said sheets positioned between said strips; and at least one carriage assembly mounted to said frame and said compression member for movement parallel to said recess, said carriage assembly engaging said compression member for applying a compressive force thereto and said carriage assembly having stud-bending means shaped and positioned to engage said excess length of said studs and bend said excess length into said grooves when said carriage assembly is moved relative to said compression member and said frame, said stud-bending means including at least one stud contracting roller movable in said track means, said stud contracting roller having a cylindrical outer surface and an annular rib protruding from said outer surface, said rib being shaped and dimensioned to engage said excess length of said studs and bend said excess length into said grooves.

* * * * *